US011754240B2

(12) United States Patent
Hua

(10) Patent No.: US 11,754,240 B2
(45) Date of Patent: Sep. 12, 2023

(54) FLOWER ARRANGEMENT WITH SOLAR LIGHTS

(71) Applicant: KAISA USA, Inc., McKenney, VA (US)

(72) Inventor: Wen Hua, Chester, VA (US)

(73) Assignee: KAISA USA, INC., McKenney, VA (US)

( * ) Notice: Subject to any disclaimer, the term of this patent is extended or adjusted under 35 U.S.C. 154(b) by 0 days.

(21) Appl. No.: 17/484,854

(22) Filed: Sep. 24, 2021

(65) Prior Publication Data

US 2022/0090750 A1 Mar. 24, 2022

Related U.S. Application Data

(60) Provisional application No. 63/081,716, filed on Sep. 24, 2020.

(51) Int. Cl.

| | |
|---|---|
| ***F21S 9/03*** | (2006.01) |
| ***F21V 33/00*** | (2006.01) |
| ***F21S 4/20*** | (2016.01) |
| ***F21V 17/10*** | (2006.01) |
| *F21Y 115/10* | (2016.01) |

(52) U.S. Cl.

CPC ..... *F21S 9/037* (2013.01); *F21S 4/20* (2016.01); *F21V 17/108* (2013.01); *F21V 33/0028* (2013.01); *F21Y 2115/10* (2016.08)

(58) Field of Classification Search

CPC ..... F21S 9/037; F21S 4/20; F21V 33/0028

See application file for complete search history.

(56) References Cited

U.S. PATENT DOCUMENTS

| | | | | |
|---|---|---|---|---|
| 3,711,696 | A * | 1/1973 | Sieloff | F21S 8/035 47/41.01 |
| 5,309,334 | A * | 5/1994 | Willison | A47G 7/044 362/147 |
| 8,585,231 | B1 * | 11/2013 | May | F21S 9/037 362/276 |
| 9,894,950 | B1 * | 2/2018 | Borslien | A41G 1/005 |
| 2005/0052883 | A1 * | 3/2005 | Qi | G09F 9/305 362/555 |
| 2013/0094191 | A1 * | 4/2013 | Cohen | F21V 21/08 362/122 |
| 2014/0313704 | A1 * | 10/2014 | Cohen | F21S 9/035 362/183 |
| 2018/0110189 | A1 * | 4/2018 | Smith | A47G 7/047 |
| 2019/0360672 | A1 * | 11/2019 | Wang | F21S 4/10 |
| 2020/0128758 | A1 * | 4/2020 | Pestl | A01G 5/04 |
| 2021/0259053 | A1 * | 8/2021 | Simpson | H05B 3/0014 |

* cited by examiner

*Primary Examiner* — Christopher E Dunay

(74) *Attorney, Agent, or Firm* — WPAT, PC

(57) ABSTRACT

Wreath is a popular home decoration or event decorations; especially during holiday season and memorial services. Traditional wreath is made of fresh flower and plant branches. Some of the modern wreath is made of plastic flower and plant branch. Some wreath even is equipped with lights for enhancing its beauty. These lights are powered by batteries or plugged into the home outlets. The connection of the power cable and the life span of the battery lift have hindered the operation of these wreaths.

8 Claims, 6 Drawing Sheets

During the day, it is charged by sunlight and lights up at night

FLOWER ARRANGEMENT WITH SOLAR LIGHTS

RELATED APPLICATIONS

This application claims priority to Provisional Application Ser. No. 63/081,716, filed Sep. 24, 2020, which is herein incorporated by reference.

FIELD OF THE INVENTION

The invention relates to a flower arrangement with solar LED lights. In particular, a wreath or a flower bouquet.

BACKGROUND OF THE INVENTION

Wreath is a popular home decoration or event decorations; especially during holiday season and memorial services. Traditional wreath is made of fresh flower and plant branches. Some of the modern wreath is made of plastic flower and plant branch. Some wreath even is equipped with lights for enhancing its beauty. These lights are powered by batteries or plugged into the home outlets. The connection of the power cable and the life span of the battery lift have hindered the operation of these wreaths.

SUMMARY OF THE INVENTION

The instant invention provides a wreath system, in particular a wreath lighting system with solar power. The instant invention eliminates the power cable requirement and battery replacement during the operation of the wreath.

DETAILED DESCRIPTION OF THE PREFERRED EMBODIMENT

Figure 1:
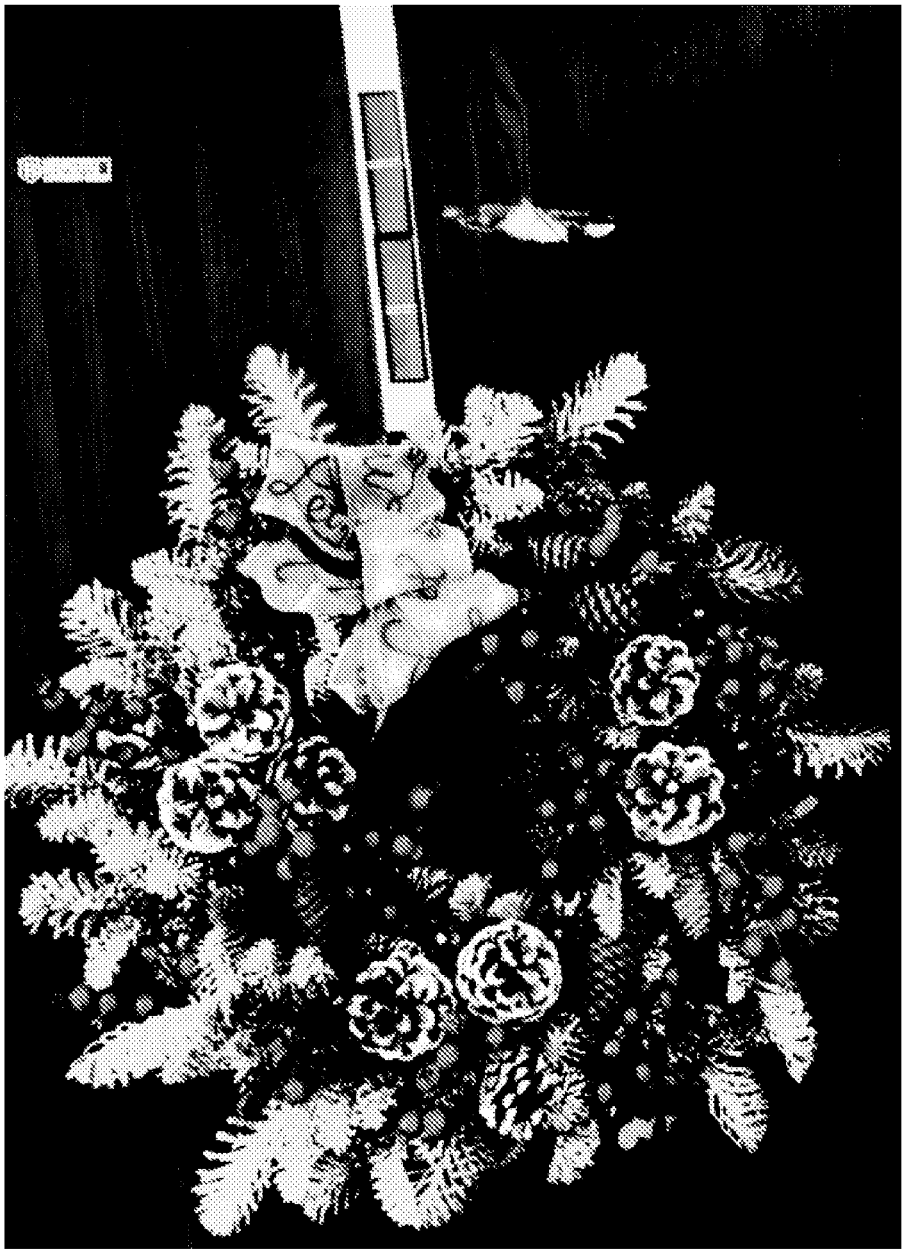
FIG. 1 shows the wreath system with lights according to the current invention.
Figure 2:
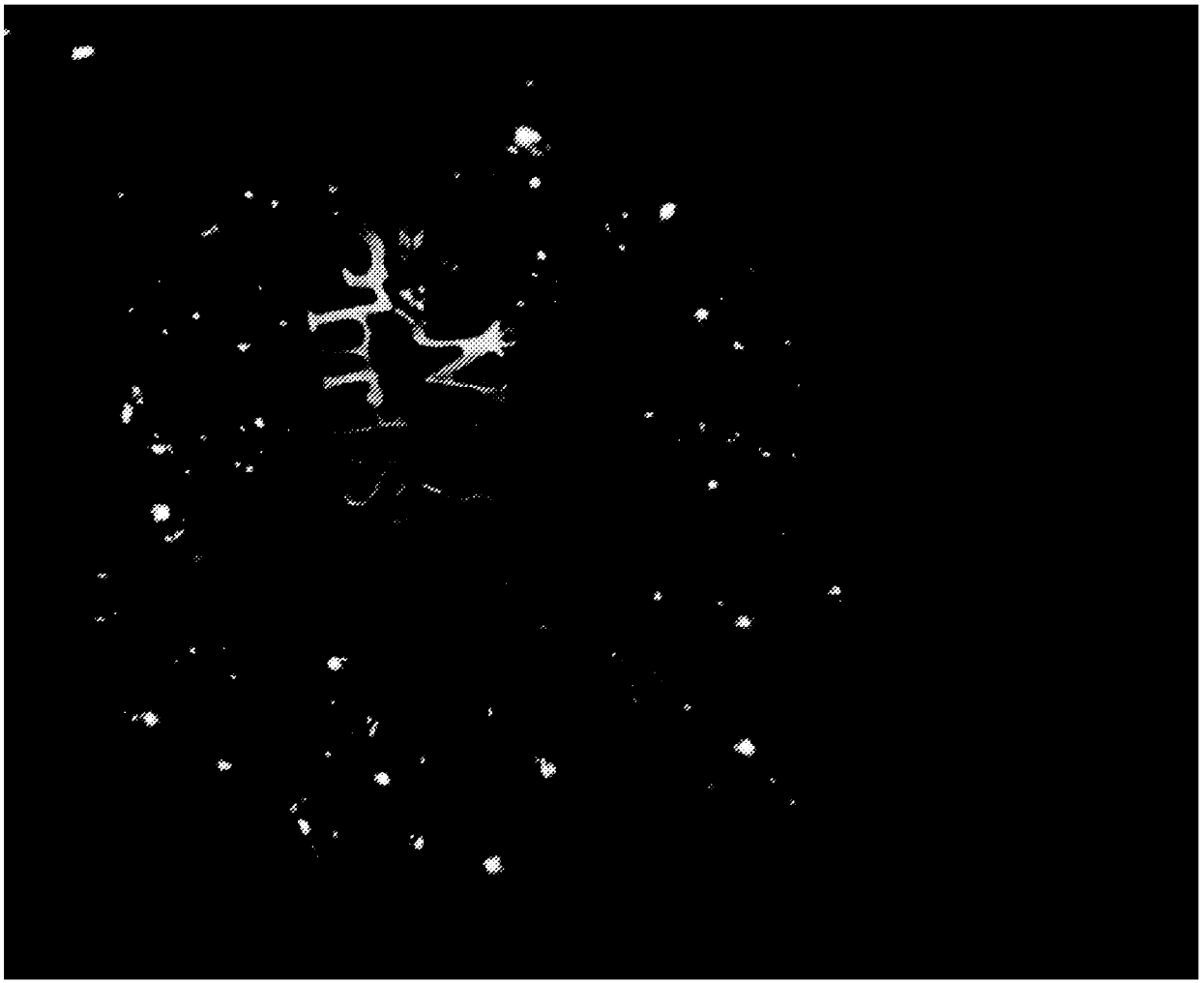
FIG. 2 shows the wreath system in operation.

FIG. 1 shows a flower arrangement in wreath according to the instant invention. The instant invention as shown in the FIG. 1 provides a wreath main body comprising main body skeleton. The LED lights are attached on the skeleton and interconnected together via either parallel or serial connections. The flower and plant branch are attached onto the main body skeleton. The flower and plant branch are either fresh ones or made of synthetic material, such as plastic. In one embodiment, the main body skeleton itself is made in a form of flower and plant branches. The wreath main body also includes a power storage device, such as at least one rechargeable battery.

The instant invention further provides a wreath hook with integrated solar panel/cell. While the wreath body is hung on the hook to be attached on the household's door or any structure, the wreath also received power from the hook's solar panel and charging the rechargeable battery.

In one embodiment, the hook and the solar panel are two separate structures. The hook has an opening or a slot or a protrusion portion or indentation portion for accommodating the solar panel. The solar panel is placed in the hook's opening or slot, or the solar panel has an indentation or a protrusion portion to attach onto the hook.

As shown in the FIG. 1, a hanging device, such as a hook, hangs the wreath on the door. The hanging device for hanging the wreath is not limited to hook. It can be any hanging device, such as a suction cup.

Figure 3:
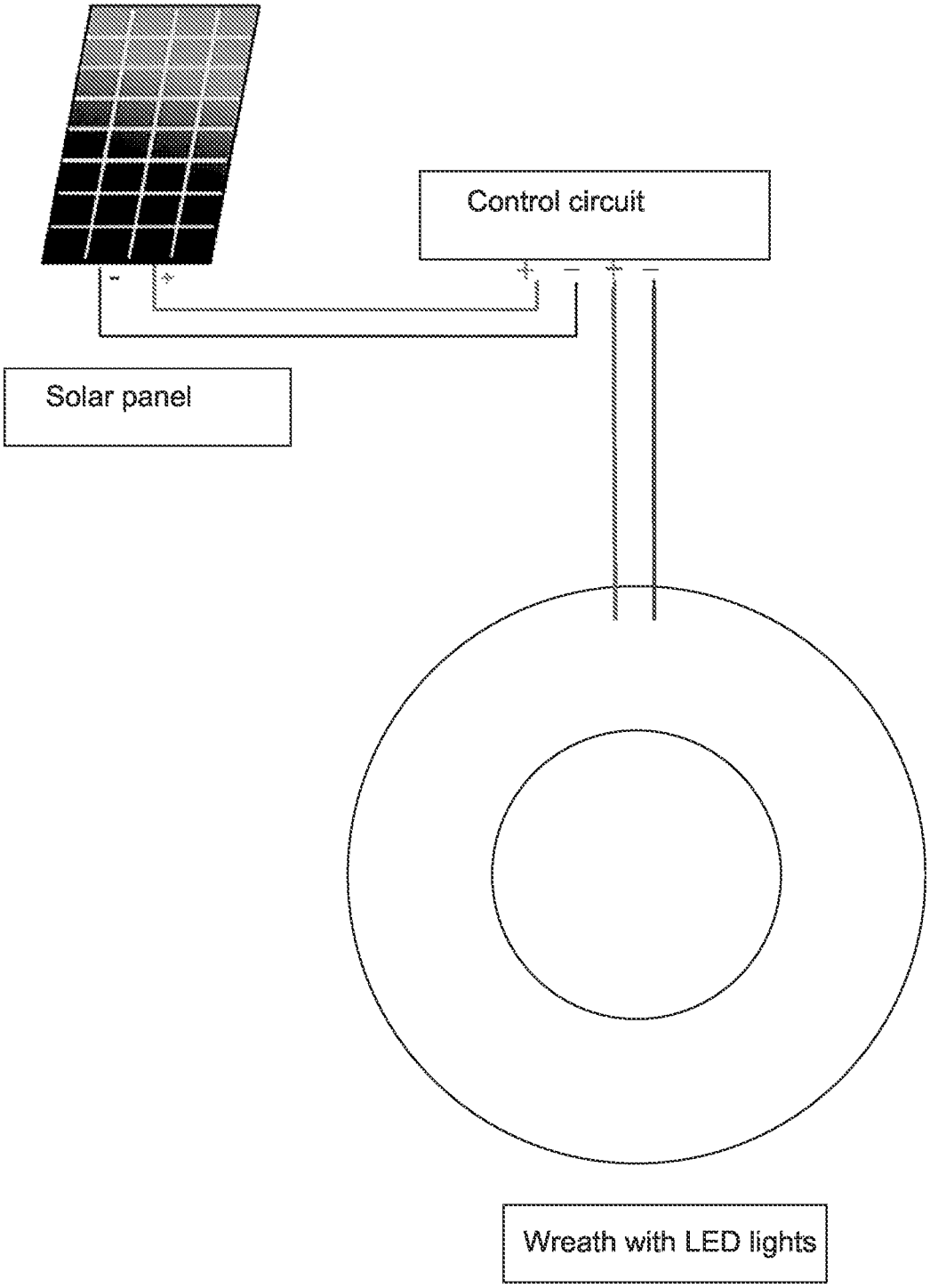
FIG. 3 shows the electrical path of the wreath system of the instant invention.

As shown in the FIG. 3, the instant invention further includes a power management circuit to control and manage the power received from the power panel or the connected power source, and for storing power into the rechargeable battery, and to turn on/off the LED light. The batteries (not shown) can be directly attached to the power panel or attached to the power management circuit, or even on the wreath.

In one embodiment, the power management circuit is positioned in the wreath main body. In another embodiment, the power management circuit is attached on the solar panel. In another embodiment, the power management circuit is attached onto the hook.

In one embodiment, while the solar panel produces voltages over a predetermined threshold during the daytime, the voltage is detected by the power management circuit, and the power is then stored in the power storage device. As the night comes, once the power management circuit detects that the voltages produced by the solar panel has dropped below the predetermined threshold, the power management circuit will connect electrical path between the LED lights and the power storage device, and the LED light is on. As the dawn comes, once the power management circuit detects that the voltages produced by the solar panel has increased above the predetermined threshold, the power management circuit will disconnect electrical path between the LED lights and the power storage device, and the LED light is off.

In one embodiment, the instant invention includes a LED operation management circuit. The LED operation management circuit has different lighting pattern or programs; it controls the LED lighting operation. In one embodiment, the LED operation management circuit and the power management circuit are one integrated circuit.

In one embodiment, each of the wreath body and the solar hook has a hook power connector for electrically connecting together. In another embodiment, the hanging portion of the wreath body functions as a conducting plate, so is the lower hook/portion of the solar hook. The wreath and hook are electrically connected once the wreath is hung on the solar hook.

In one embodiment, the instant invention also includes a sensor or manual switch for activating the LED light. The sensor can be a dawn sensor or motion sensor, and the sensor is connected to the power management circuit as shown in FIG. 3.

In one embodiment, the instant invention also includes a power cable for connecting to a household outlet for backup power source.

In one embodiment, the instant invention also includes a LED display for displaying the rechargeable battery available power. In another embodiment, the instant invention also includes a wires communication circuit for user to monitor or control the wreath operation in a remote distance.

Figure 4:
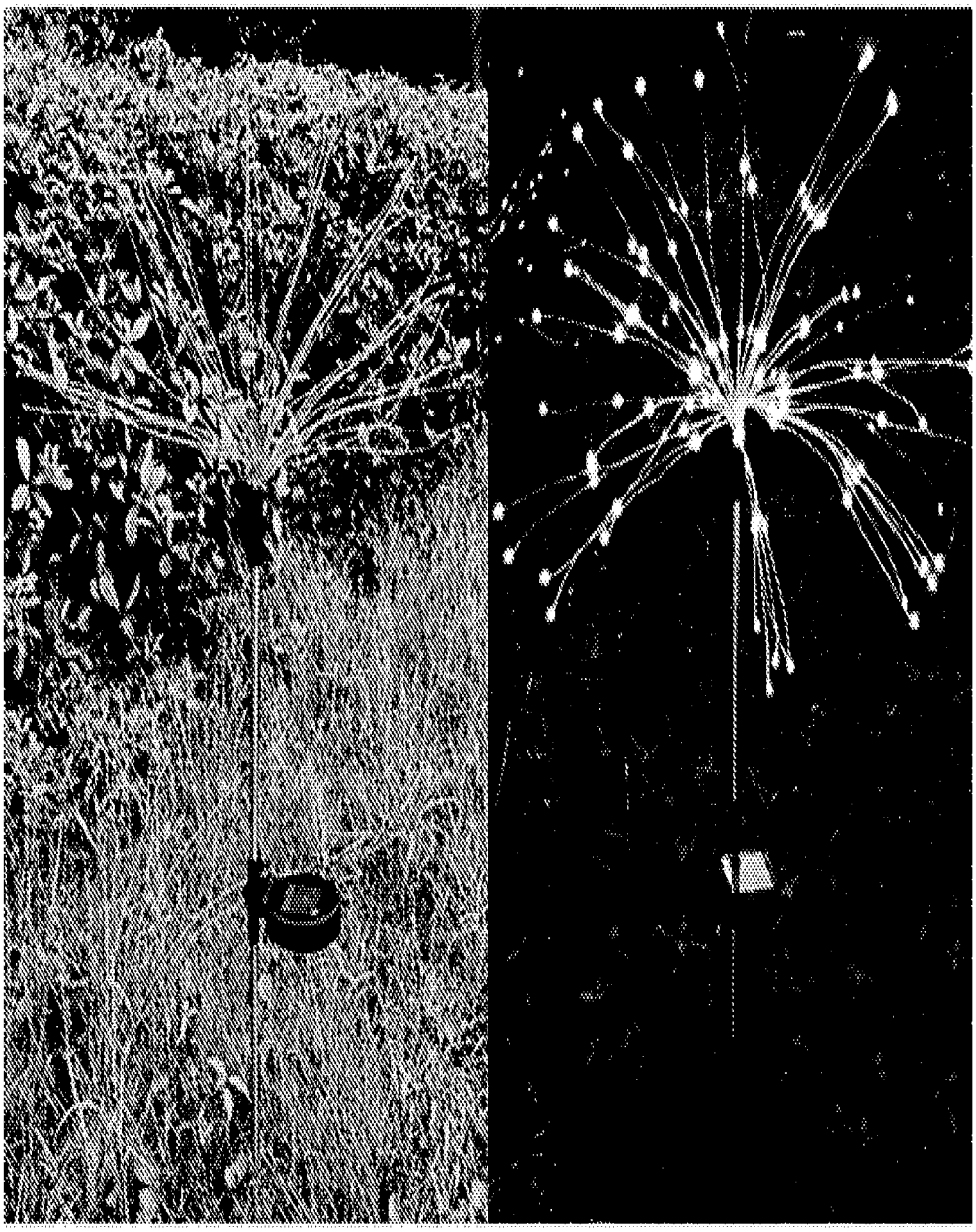
FIG. 4 shows the lights arrangement according to the current invention.
Figure 5:
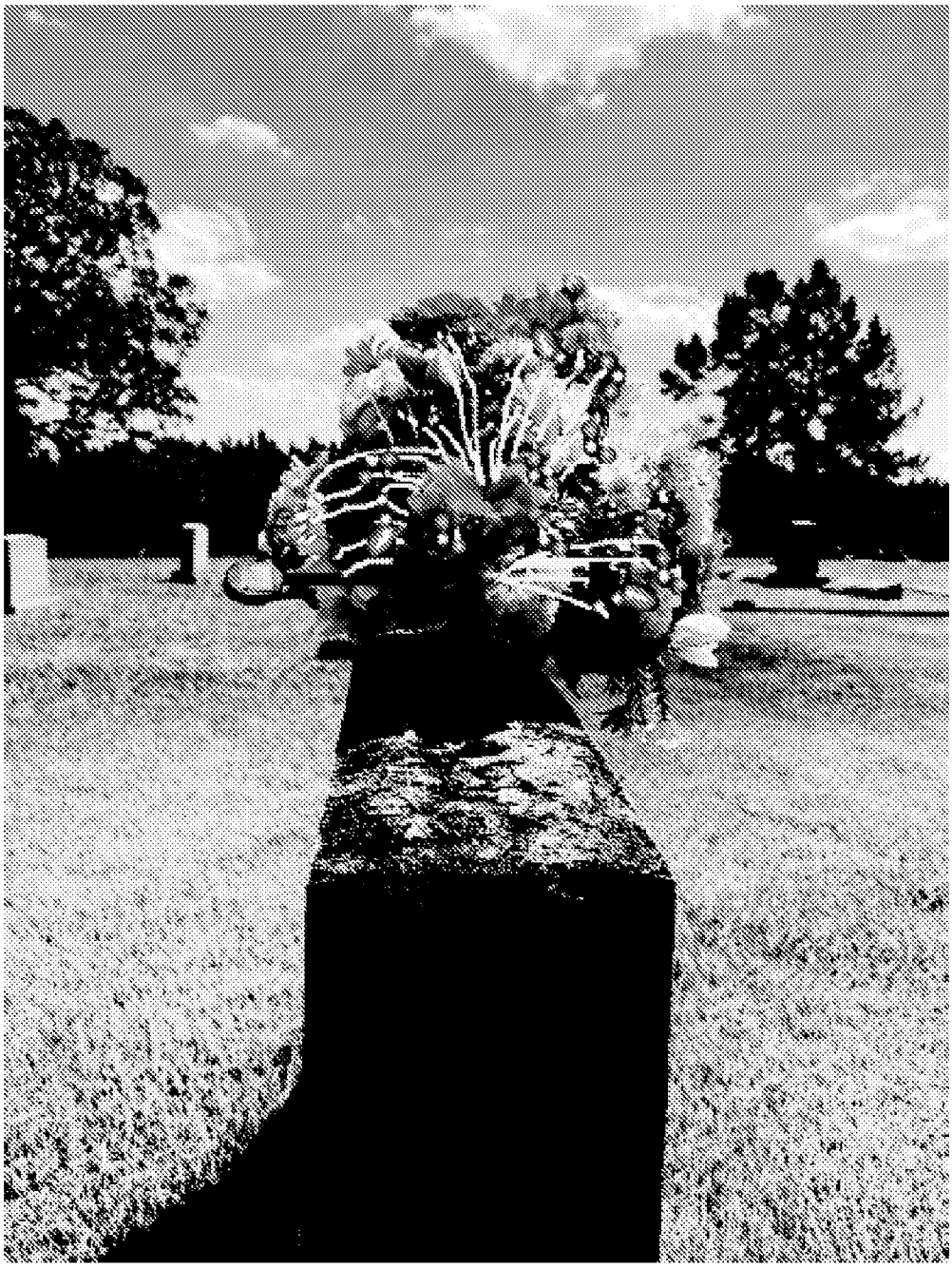
FIG. 5 shows the flower arrangement with the light arrangement as shown in FIG. 4.
Figure 6:
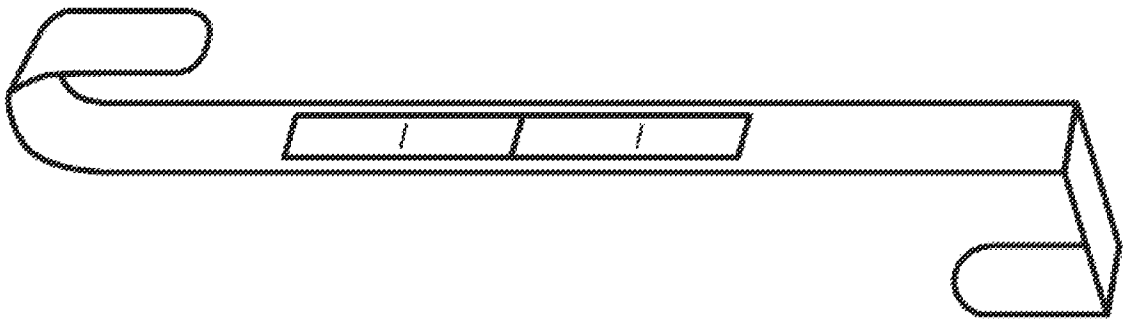
FIG. 6 shows various hanging device hooks able to be used with the flower arrangement as shown in FIG. 1.

In another embodiment, the flower arrangement is in a form of flower bouquet. The solar panel is equipped on the bouquet vase or directly attached to the bouquet. As shown in FIGS. 4 and 5, the flower arrangement can be bouquet instead of a wreath. As shown in FIG. 4, a spread-out light arrangement and a solar panel are attached onto the supporting rod which sticks into the ground. The solar panel can have integrated power management circuit with sensor, or the solar panel and power management circuit can also be separated and attached onto the supporting rod individually. A plurality of branches with lights at each end is attached on the top of the supporting rod. Each branch tip end can equipped with one or more LED lights, or each branch can be an optical fiber with one or more light sources positioned within the top of the supporting rod.

FIG. 5 shows a bouquet with the light arrangement from FIG. 4. The solar panel is attached on to the supporting rod with a hinge, which enables repositioning the solar panel for facing the sun. Each light branch can be made of metal or other suitable material, and be cable of repositioned within the bouquet for optimal lighting effect. The lower portion of the supporting rod can also be detached if not in use.

While the invention has been described in terms of what is presently considered to be the most practical and preferred embodiments, it is to be understood that the invention needs not to be limited to the above embodiments. On the contrary, it is intended to cover various modifications and similar arrangements included within the spirit and scope of the appended claims which are to be accorded with the broadest interpretation so as to encompass all such modifications and similar structures.

What is claimed is:

1. A flower arrangement, comprising:

a skeleton for attaching fresh flowers or artificial flowers;

a supporting device for supporting said skeleton, said supporting device comprising a hanging device;

a solar panel attached to said supporting device and inserted into a slot of said hanging device;

a rechargeable battery;

a power management circuit, wherein said power management circuit control charging and discharging said rechargeable battery; and a plurality of LED lights powered by said rechargeable battery;

wherein said skeleton is a plurality of branches, and each end of said branches illuminates from a respective one of the plurality of LED lights positioned on the distal end of each of the plurality of branches.

2. The flower arrangement of claim 1, further comprising:

a dawn sensor connecting to said power management circuit.

3. The flower arrangement of claim 1, wherein said solar panel is mounted flush with the surface of said hanging device.

4. The flower arrangement of claim 1, wherein each of said at least one LED light is positioned among decorative materials and said attached fresh flowers or artificial flowers.

5. The flower arrangement of claim 1, wherein said hanging device is a hook.

6. A flower arrangement, comprising:

a skeleton for attaching fresh flowers or artificial flowers, the skeleton comprising a plurality of branches;

a supporting device for supporting said skeleton, said supporting device comprising a supporting rod;

a solar panel attached to said supporting device;

a rechargeable battery;

a power management circuit, wherein said power management circuit control charging and discharging said rechargeable battery; and a plurality of light-emitting diodes (LEDs), wherein one of the plurality of LEDs is positioned at a respective first distal end of each branch of said plurality of branches such that said first distal end of each branch illuminates.

7. The flower arrangement of claim 6, further comprising:

a hinge for connecting said solar panel to said supporting rod.

8. The flower arrangement of claim 6, wherein said supporting rod comprises a detachable stick section for sticking said supporting rod into ground.

* * * * *